US005973905A

United States Patent [19]

Shaw

[11] Patent Number: 5,973,905

[45] **Date of Patent: *Oct. 26, 1999**

[54] NEGATIVE AIR ION GENERATOR WITH SELECTABLE FREQUENCIES

[76] Inventor: Joshua Shaw, 63 Manly Drive, Robina Queensland, Australia, 4226

[ * ] Notice: This patent issued on a continued prosecution application filed under 37 CFR 1.53(d), and is subject to the twenty year patent term provisions of 35 U.S.C. 154(a)(2).

[21] Appl. No.: 08/817,352

[22] PCT Filed: Oct. 20, 1995

[86] PCT No.: PCT/AU95/00697

§ 371 Date: Apr. 10, 1997

§ 102(e) Date: Apr. 10, 1997

[87] PCT Pub. No.: WO96/13086

PCT Pub. Date: May 2, 1996

[30] Foreign Application Priority Data

Oct. 20, 1994 [AU] Australia ..... PM 8930

[51] Int. Cl.[6] ..... H05F 3/04

[52] U.S. Cl. ..... 361/231; 361/235; 361/232

[58] Field of Search ..... 361/213, 214, 361/216, 217, 225, 229, 230, 231, 235, 250, 324–326

[56] References Cited

U.S. PATENT DOCUMENTS

| | | | |
|---|---|---|---|
| 4,200,909 | 4/1980 | Milum | 363/144 |
| 4,306,271 | 12/1981 | Weber | 361/229 |
| 4,689,715 | 8/1987 | Halleck | 361/213 |
| 4,757,422 | 7/1988 | Bossard et al. | 361/231 |
| 4,951,172 | 8/1990 | Steinman et al. | 361/213 |
| 5,317,155 | 5/1994 | King | 250/324 |

*Primary Examiner*—Jeffrey Gaffin
*Assistant Examiner*—Kim Huynh
*Attorney, Agent, or Firm*—Vedder, Price, Kaufman & Kammholz

[57] ABSTRACT

A negative ion generator is provide with a plurality of needle assemblies, each of which has a distinct needle end point. The generator includes a drive circuit for providing high voltages to the needle end points and a selection circuit by which the amount of and/or the frequency at which the ions are produced. The needle assemblies are replaceable by the user by way of plug and socket style connections. An indicating means is provided for indicating to the user of the generator the condition of the needle assemblies and when the needles should be replaced. The drive circuit can include a safety current route in the event of an earth fault.

23 Claims, 7 Drawing Sheets

NEGATIVE AIR ION GENERATOR WITH SELECTABLE FREQUENCIES

TECHNICAL FIELD OF THE INVENTION

THIS INVENTION relates to improvements in or in relation to negative air ion generators for production of small biologically active (ingestible) ions.

BACKGROUND ART

The thrust of experimental data to date shows that small negatively charged air ions are biologically active providing improved health through ingestion of negative air ions over time.

Ion depletion in modern urban life by air borne pollutants has been documented as producing adverse effects on body serotonin levels and production of higher than normal histamine levels in some people producing adverse physiological and psychological effects.

The presence of negative air ions capable of being inhaled and ingested has been shown to assist the body to return to its own natural balance producing positive effects on health.

At present, negative ion generators suffer from a number of disadvantages.

At present, negative air ion generators are not capable of producing small highly mobile biologically active negative ions consistently over an extended time period and the lack flexibility in terms of the variability of production rate and quantities of ions produced.

In addition, due to the high voltages employed to produce ions, ion generators are prone to corrosion and wear so that ion generation can cease without a user being aware.

OUTLINE OF THE INVENTION

It is an object of the present invention to alleviate at least to some degree the above-mentioned deficiencies of the prior art.

In devising the present improvements to negative ion generators, the applicant has produced a number of independent inventions which can be used separately but have synergism and are more preferably used together in combination.

Nevertheless, the applicant recognizes the possibility that inferior products may be made utilizing one or more of the applicant's inventions.

The applicant has therefore set out in this present specification, each invention in independent form and also in combination and reserves the applicant's rights to divide each invention or to claim the inventions in novel combination.

In the present invention, there is provided a negative air ion generator comprising an emitter, typically a needle point, a driver circuit for generating ions at the emitter, the drive circuit producing an ion generation signal, the ion generation signal comprising a carrier wave which is frequency modulated at a selected one of a number of selectable frequencies. The selectable modulation frequencies are typically about 40 Hz, about 25 Hz, about 10 Hz or about 7.83 Hz. The carrier frequency is from 15 kHz to 20 kHz with about 17.25 kHz being typical.

In one form, there is provided a negative air ion generator having at least one needle assembly having a needle point and a driver circuit providing voltage to the needle point to produce air ions, the needle assembly having a socket surrounded by a socket housing carrying a terminal extending from the housing terminal being soldered in the driver circuit, the needle point being removably held in the socket, the socket, socket housing and terminal being plated over its entire surface with a corrosion resistant metal such as gold or its functional equivalent.

The needle point is preferably made from a corrosion resistant alloy. Typically, a ruthenium alloy is employed.

In a second form, there is provided a negative air ion generator having at least one needle assembly including a replaceable needle point and a driver circuit 28, 28' providing voltage to the needle assembly to generate ions at the needle point, a time circuit 172 and a needle replacement indicator, 170 the time circuit being operable to actuate the needle replacement indicator after a predetermined period of time indicative of expiration of needle life. Typically, expiration of needle life is not usually complete cessation of ion production but is an average time period beyond which ion production slows and is a recommended time for replacement.

The timing circuit 172 preferably includes a solid state memory device periodically addressed to time the predetermined period of time and to provide a trigger signal in response to the expiration of said predetermined period of time. The sold state memory device is typically an Electrically Erasable Programmable Read Only Memory (EEPROM). The EEPROM is typically configured to use sequential EEPROM cells as pointed to by the first cell in order to evenly distribute write cycles to the cells of the EEPROM in order to prolong EEPROM life. Upon replacement of expired needles, the time circuit includes a reset which for manually resetting the EEPROM to recommence countdown of the predetermined period of time. Preferably, the needle replacement indicator provides a visual indication pending needle expiration and a second visual indication of needle expiration. Most preferably, the needle replacement indicator provides three indications with a first indication indicating that needle life is currently within the predetermined period of time, a second indication indicating that needle life is approaching the end of the predetermined period of time and a third indication indicating that needle life has exceeded the predetermined period of time. The predetermined period of time is typically not less than about 2000 hours and not more than about 2500 hours.

In a further form, there is provided a negative air ion generator having at least one needle assembly including a replaceable needle point and a driver circuit providing voltage to the needle point to generate ions at the needle point, an earth disposed adjacent the needle point at a distance of 15 mm to 20 mm therefrom and preferably about 17 mm therefrom. Typically, a plurality of needle assemblies are employed being configured as a ring of circumferentially spaced needle assemblies and said earth comprises a ring disposed 15 to 20 mm from the ring of needle points, preferably 17 mm from the ring of needle points.

In another further form, there is provided a negative air ion generator including at least one needle assembly having a replaceable needle, a driver circuit and selection circuit means for selection of ion levels to vary the amount and/or frequency at which ions are produced. Typically, the ion generator enables selection of the quantity of ions produced by changing the magnitude of the driver signal to produce more or less ions at any frequency setting, the drive signal typically having a carrier frequency modulated at defined frequencies. The carrier frequency is typically a frequency in the range of 15 kHz to 20 kHz, preferably being a square wave having 17 kHz preferred frequency. Modulation frequency is typically selected from one of the following frequencies:

(i) about 40 Hz;

(ii) about 25 Hz;

(iii) about 10 Hz; and (iv) about 7.83 Hz.

The number of ions is preferably variable from as slow as about 50,000 negative ions per CC at one meter to as high as about 400,000 negative ions per CC at one meter.

In yet another further form, there is provided a negative air ion generator including at least one needle assembly having a replaceable needle point and a driver circuit, the driver circuit having a crystal control oscillator controlling application of a time varying voltage to the needle point.

In an alternate form, there is provided a negative air ion generator comprising a needle assembly and a driver circuit 28, 28' connected to the needle assembly to generate ions at the needle assembly, the needle assembly including first terminal connector means in said driver circuit and second terminal connector means adapted to be frictionally and releasably held by the first connector means, the second connector means being adapted to hold a needle having a needle point at which ions are generated, the terminal connector means having corrosion resistant contact surfaces between said connector means and said needle point. Preferably, the contact surfaces are plated with gold or its functional equivalent. Preferably, the entire surface of the first and second terminal connectors are surface coated with the corrosion resistant conductive materials.

Preferably, the first terminal connector means includes a socket and the second terminal connector means includes a plug and a needle socket, the plug being releasably held in said socket of said first terminal connector means, the first and second sockets and the plug having frictional contact surfaces, the contact surface at least being coated with corrosion resistant material.

In a still further form, there is provided a negative air ion generator comprising an emitter, typically a needle point, a driver circuit for generating ions at the emitter, an AC mains power supply inlet to the driver circuit having a mains active, mains neutral and ground terminal, the driver circuit having an effective ground potential connection between the driver circuit and the mains ground terminal, there being provided a safety current route through a resistor to the neutral terminal in the event that the mains earth is faulty.

In a further form, there is provided a compact negative air ion generator having an emitter, typically needle point, a driver circuit for generating ions at the emitter and a compact casing housing the driver circuit, the driver circuit including a control circuit and a high voltage circuit, the control circuit and high voltage circuit being spaced from one another within the casing by a distance insufficient to prevent arcing, an insulator disposed between the control circuit and high voltage circuit in order to prevent arcing.

BRIEF DESCRIPTION OF THE DRAWINGS

In order that the present invention can be more readily understood and be put into practical effect, reference will now be made to the accompanying drawings and wherein.

METHOD OF PERFORMANCE

Figure 1:
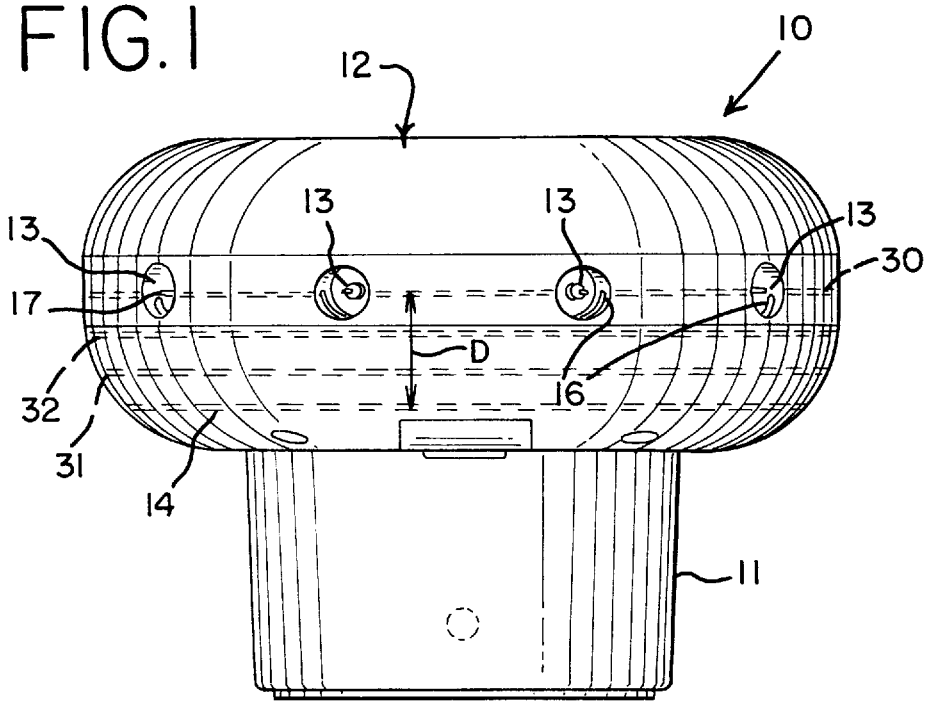
FIG. 1 and 2 are front and rear elevational views illustrating a negative air ion generator.
Figure 2:
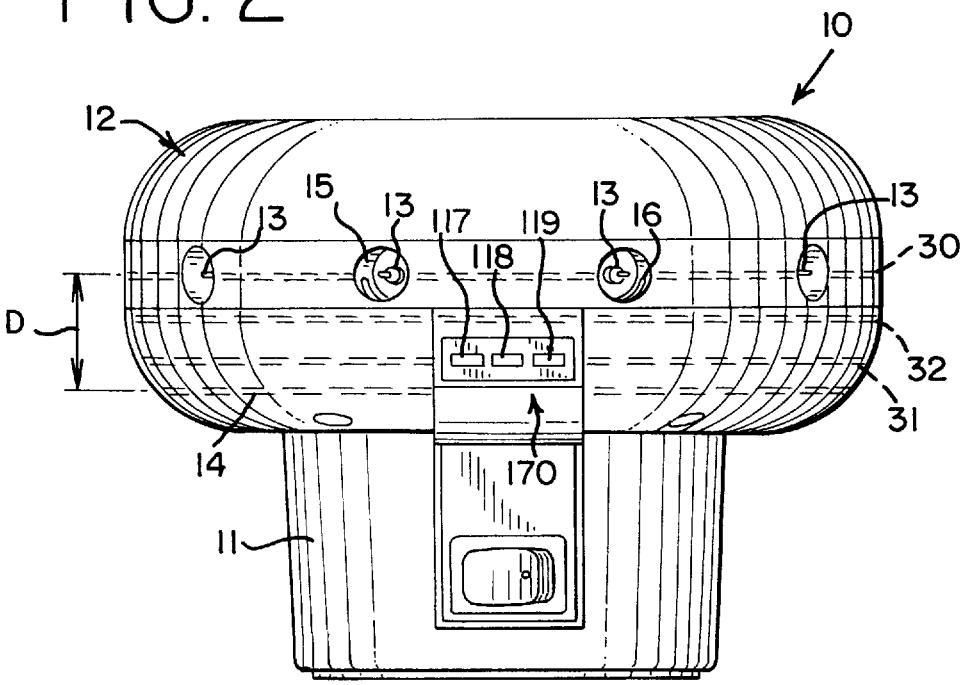

Referring to the drawings and initially to FIGS. 1 and 2, there is illustrated a negative air ion generator 10 which is generally mushroom shaped having narrow cylindrical body portion 11 and an upper enlarged cylindrical body portion 12. The negative air ion generator 10 is provided with a circular array of needle emitters 13 with eight in total and four being disposed generally in opposite directions on the upper body portion 12. Located at a separation distance D of approximately 17 mm below the ring of emitters 13 is an earth ring 14 shown in phantom and this is positioned from 15 mm to 20 mm with 17 mm as shown being optimum for the generation of small ions.

Each emitter is located in a recess 15, each recess having a slot 16 for flow of ions between the needle points 17 and the earth ring 14.

As can be seen, the negative ion generator is relatively compact when compared with prior art devices and a consequence is prone to arcing between the high voltage circuit being carried on a board shown in phantom at 30 and the control circuit shown in phantom at 31 which are separated within the unit. In the present case, the generator 10 is about 10 cm high and to prevent arcing an insulating disc 32 is disposed about halfway between the boards 30 and 31. The insulating disc in this case is a 1 mm thick polycarbonate.

The portions 11 and 12 are preferably made from a low outgassing plastics, preferably from a plastics that is from chlorine and bromine flame retardants. A suitable plastic is available from Bayer, the Bayer brand and identification being "Bayblend KU-1-448" available from Bayer Australia Limited of 875 pacific Highway, Pymble, New South Wales, 2073, Australia. The plastic has been specially selected by the applicant, bearing in mind its outgassing characteristics.

Figure 3:
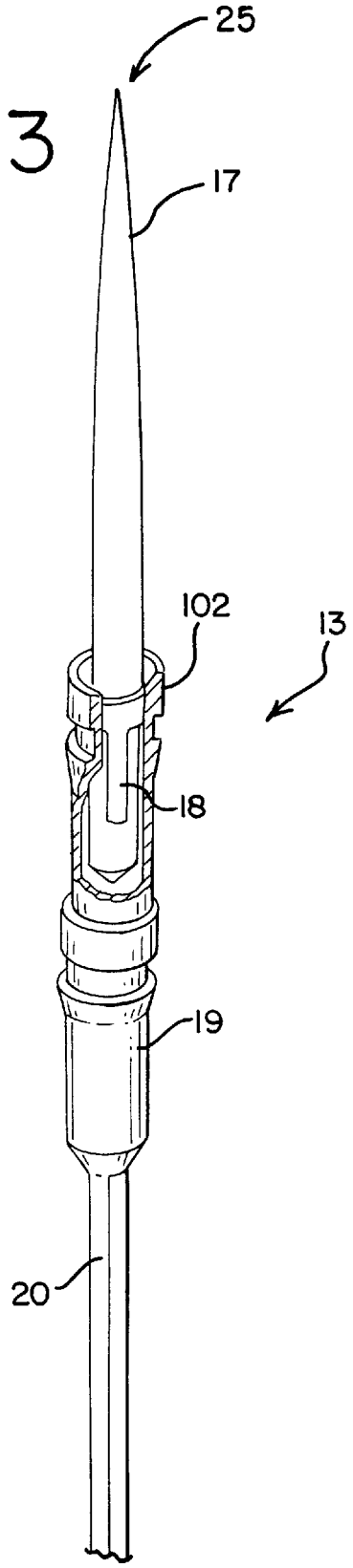
FIG. 3 is a cut-away perspective view illustrating a needle assembly according to the present invention.
Figure 4:
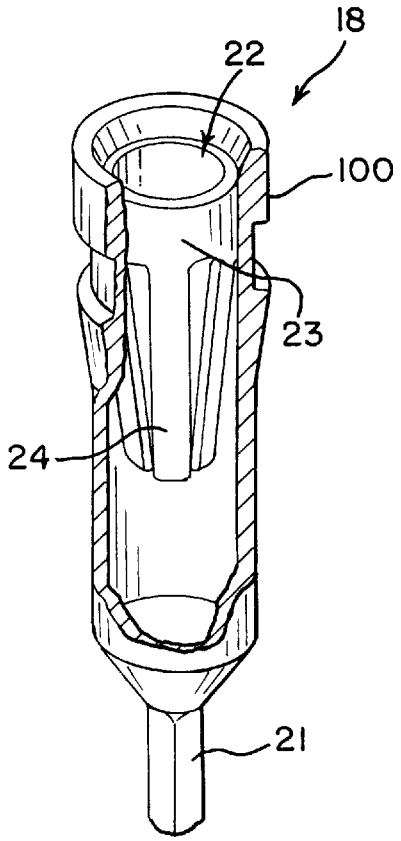
FIG. 4 is an enlarged view of a second terminal connector means being part of the assembly of FIG. 3.
Figure 5:
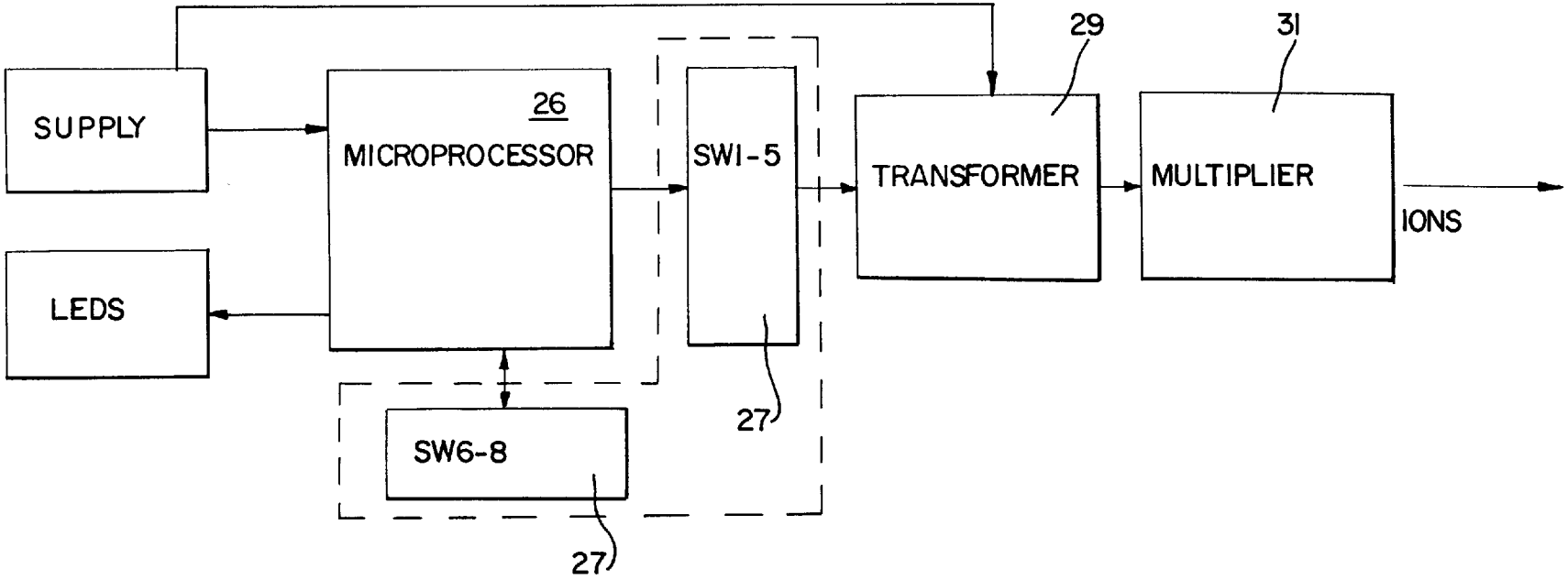
FIG. 5 is a schematic block diagram of a negative air ion generator according to the present invention.

Referring now to FIGS. 3 and 4, there is illustrated a needle emitter assembly 13 having a replaceable needle point 17 releasably retained in a second connector 18 shown in cut-away. The second connector is also releasably retained in the first socket of a first connector 19, the first connector includes a pin 20 adapted to be soldered in circuit to provide fixed connector having a socket configured internally in similar fashion to the socket illustrated in cut-away in FIG. 4. Both the connectors 18 and 19 are configured with the same general internal construction, having a plug 21 and a socket assembly 22, the socket assembly 22 having a internal sleeve 23 with resiliently biased legs 24 adapted to frictionally engage the needle point 17 as shown in FIG. 3, in case of connector 19 the plug 21 of the connector 18 when inserted into the socket of the connector 19.

In this construction, the replaceable needle 17 is held within a second connector (FIG. 4) 18 having a socket assembly 22 that includes an inner sleeve 23 that is held within a second housing portion 100 of the second connector 18, such that the inner sleeve 23 and the housing cooperatively define a second socket that receives the replaceable needle 17. As shown in FIG. 3, the socket assembly 22 and particularly the second housing portion 100 of the second connector 18 has a plug end 21 that is received within a first housing portion 102 of the first connector 19 that a first socket of the overall needle assembly 13 and that is insertable into the ion generator housing.

In the illustrated embodiment, all of the surfaces of the connector 19 and the connector 18 are gold plated to minimize corrosion, bearing in mind any shoulder, edge or defect, for example, arising due to corrosion can provide a site for the generation of ions and thereby reduction in the overall life of the needle assembly. In addition to the aforementioned gold plating, the needle may itself be formed from a corrosion resistant material, such as a ruthenium alloy.

It will be appreciated that the optimum is for ions to be generated at the very tip 25 of the needle point 17 rather than at other positions on the needle assembly. Use of the corrosion resistant coating enhances the production of ions at the needle point and prolongs the life of the needle assembly.

Referring now to the additional drawings, the description of a preferred circuit arrangement for generation of ions according to the teachings of the present inventions will now be described.

Figure 8:
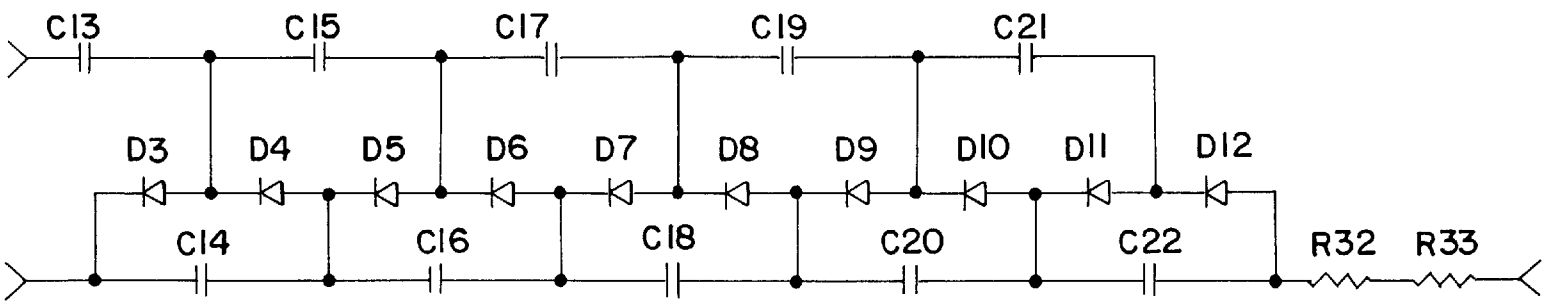
FIG. 8 is a schematic diagram illustrating a power supply circuit suitable for use with the ion generators of the present invention.

The present generator uses a Cockcroft Walton multiplier illustrated generally at 31 in FIG. 8, to generate high tension voltages of between 5 and 12 kV, derived from a ferrite tuned transformer 104 driven at 17 kHz. This provides a much more stable and medically effective output than in prior devices.

Figure 7:
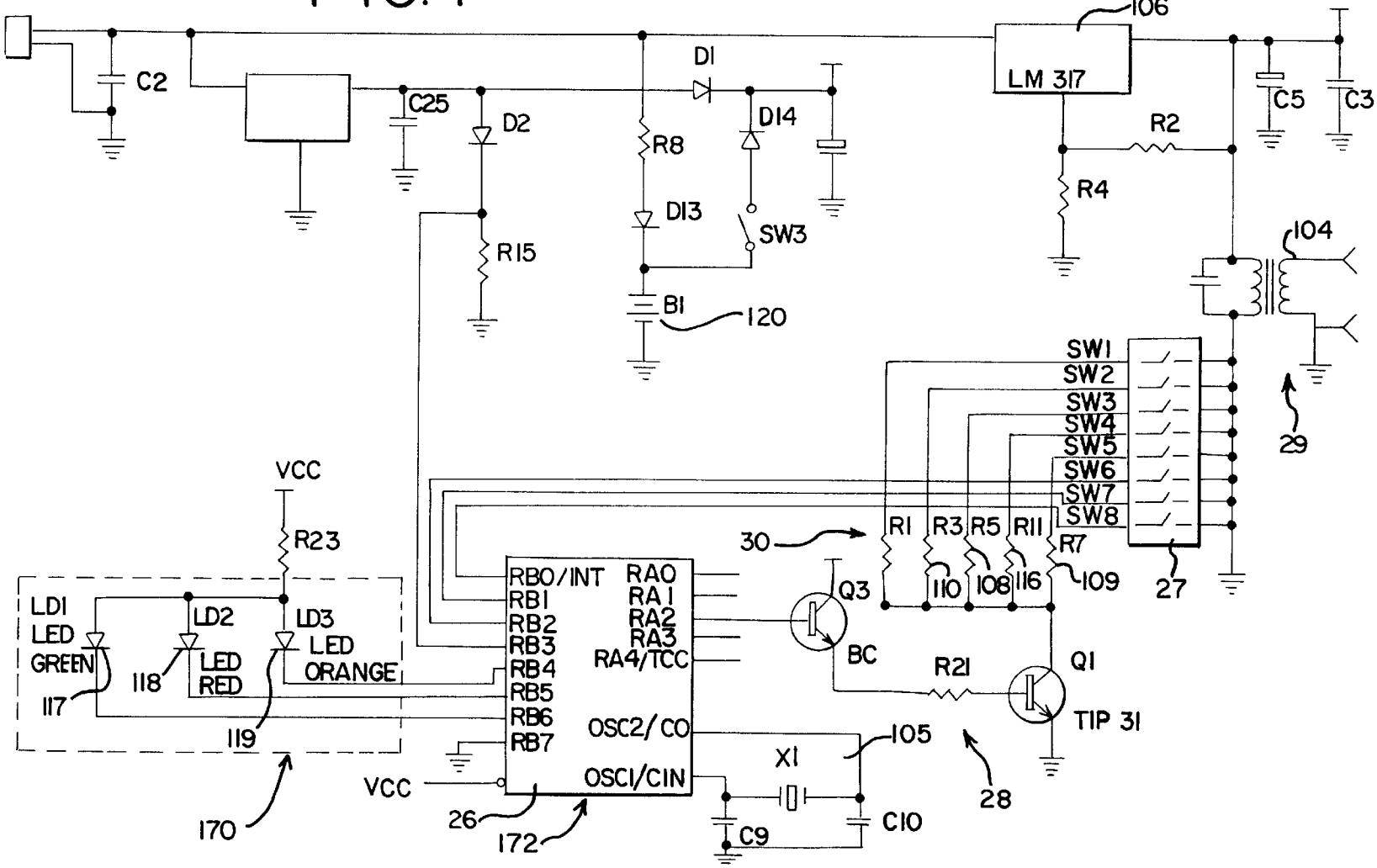
FIG. 7 is a schematic diagram illustrating the control and operating circuitry of the ion generator of FIG. 1.

In present unit, the main supply is transformed and rectified to give 16 volts DC which is then regulated to 10 volts DC for driving the main control circuitry, this contains a microprocessor 26 which is crystal controlled by a crystal oscillator X1, illustrated generally as 105 in FIG. 7 to generate 15 microsecond pulses at 17 kHz. This in turn is modulated at one of four rates under control of switches 6 to 8 on DIP (dual in-line package) switch 27. The pulses are fed to a Darlington driver transistor circuit 28 that feeds to transistor $Q_1$, first and then to transistor $Q_3$, as shown in FIG. 7 which energizes the pulse transformer 29 capacitively tuned to act in class C mode. The drive to this is limited by a set of resistors at 30 selectable by switches 1 to 5 at DIP switch 27 to give a range of ion outputs. The transformer 29 has a turns ratio of 120:1 and thus gives an output of up to 2400 volts AC peak-to-peak. This in turn is multiplied by a five stage multiplier 31 shown in FIG. 8 to generate high voltages necessary for ionization, such as about 12,000 volts DC.

Figure 10:
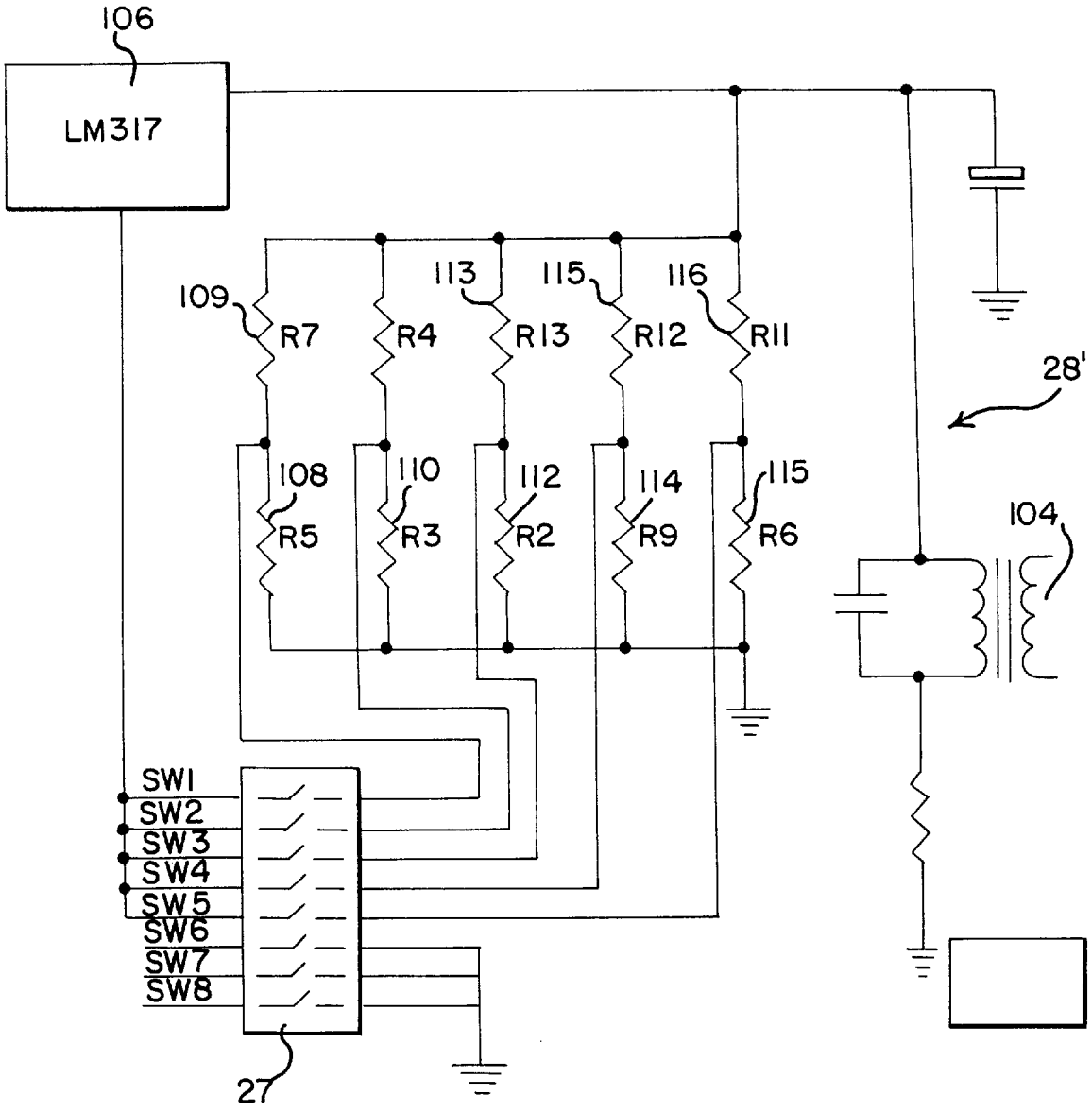
FIG. 10 is an alternative driver circuit for a negative air ion generator according to the present invention.

An alternate arrangement 28' to the Darlington driver circuit 28 is shown in FIG. 10. In this arrangement, the coil resistance of resistor R1 is held constant at 1 ohm and a set of switches SW1 to SW5 change the settings on the variable voltage regulator LM317106. The settings are changed by switching in different ratios, the resistor sets R5, R7, R3; R2, R13; R9, R12 and R6, R11, illustrated respectively as 108, 109, 110,112, 113, 114, 115 and 116. This stratagem permits the inductance of the transformer 104 to vary and, with switching two ratio sets in parallel, the ionizer can give 9 output voltages from 5 switches of the DIP switch 27.

The modulation switches the pulse train on and off at a rate controlled by switches 6 to 8 of the DIP switch 27; with all switches off, the rate is 40 Hz, switch 6 on changes this to 25 Hz; switch 7 sets the modulation at 10 Hz and switch 8 defines the rate at 7.83 Hz. Note that in this definition, a cycle contains two "on" periods and two "off" periods.

Thus it can be seen that the ion generation signal may be frequency modulated with the modulation frequency chosen from a range of frequencies and with the modulation frequency being selectable by changing the settings of the DIP switch 27, and in particular the settings of switch numbers 6–8 thereof.

As it is necessary to replace needle points at regular intervals, since the corona discharge at the tips causes the needles to wear, the microprocessor warns the user of this by activating one of three LEDS 117–119; green 117 for the first 2000 hours, amber 118 for the next 104 hours and red 119 thereafter, signifying the needles should be replaced. Since the unit may be switched off, the timing is stored by the microprocessor 26 in an EEPROM. A reset switch is provided to restart the hours count when the needles have been replaced. In the illustrated embodiment and since the reset must be effected when the mains power is not applied, a rechargeable battery B1 illustrated generally at 120 in FIG. 7 is included to supply the microprocessor 26 at this time.

Figure 9:
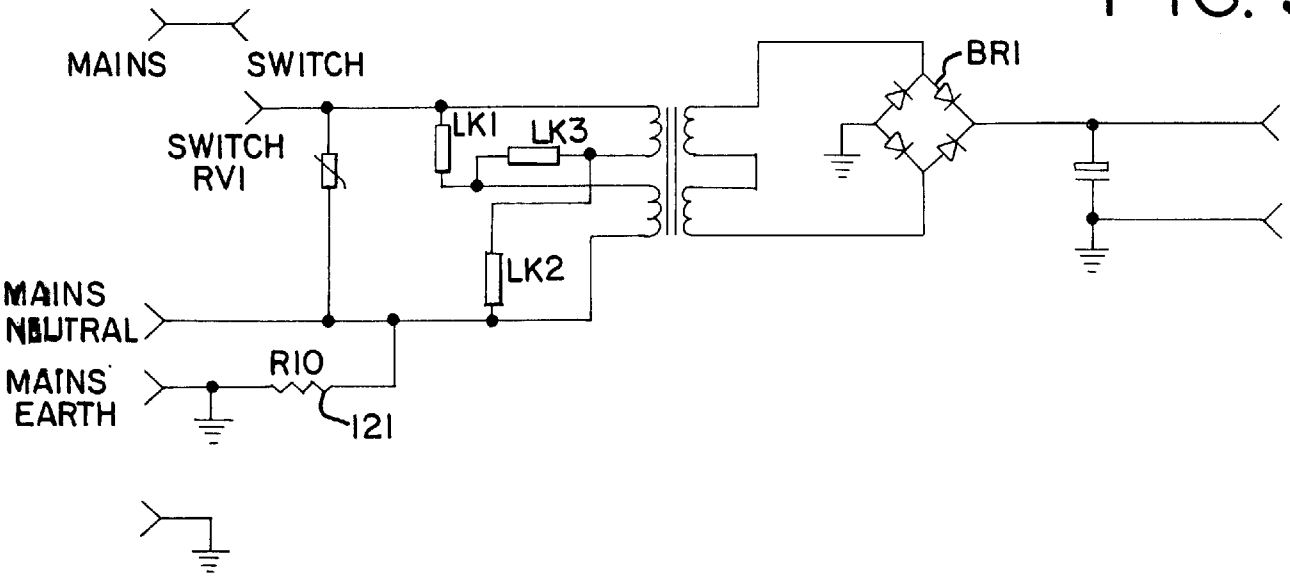
FIG. 9 is a schematic diagram illustrating the voltage multiplier circuit used by the ion generator of the present invention to produce the high voltages at the needle tips of the generator.

In order that the ions may be properly released, the unit includes an earth ring located in a plane below the needles as previously described. This is grounded to the mains earth. In the event that the mains earth is faulty, a charge build up is prevented by connection of a large resistor (R10 in FIG. 9), in this case 68MΩ between the incoming ground and neutral wires.

The resistor reduces arcing, in previous devices charge build up causes arcing which gives an audible clicking sound at any available earth point, for example, at the mains power point. The voltage dropped across the resistor is about 150 V DC if the earth fails.

Figure 6:
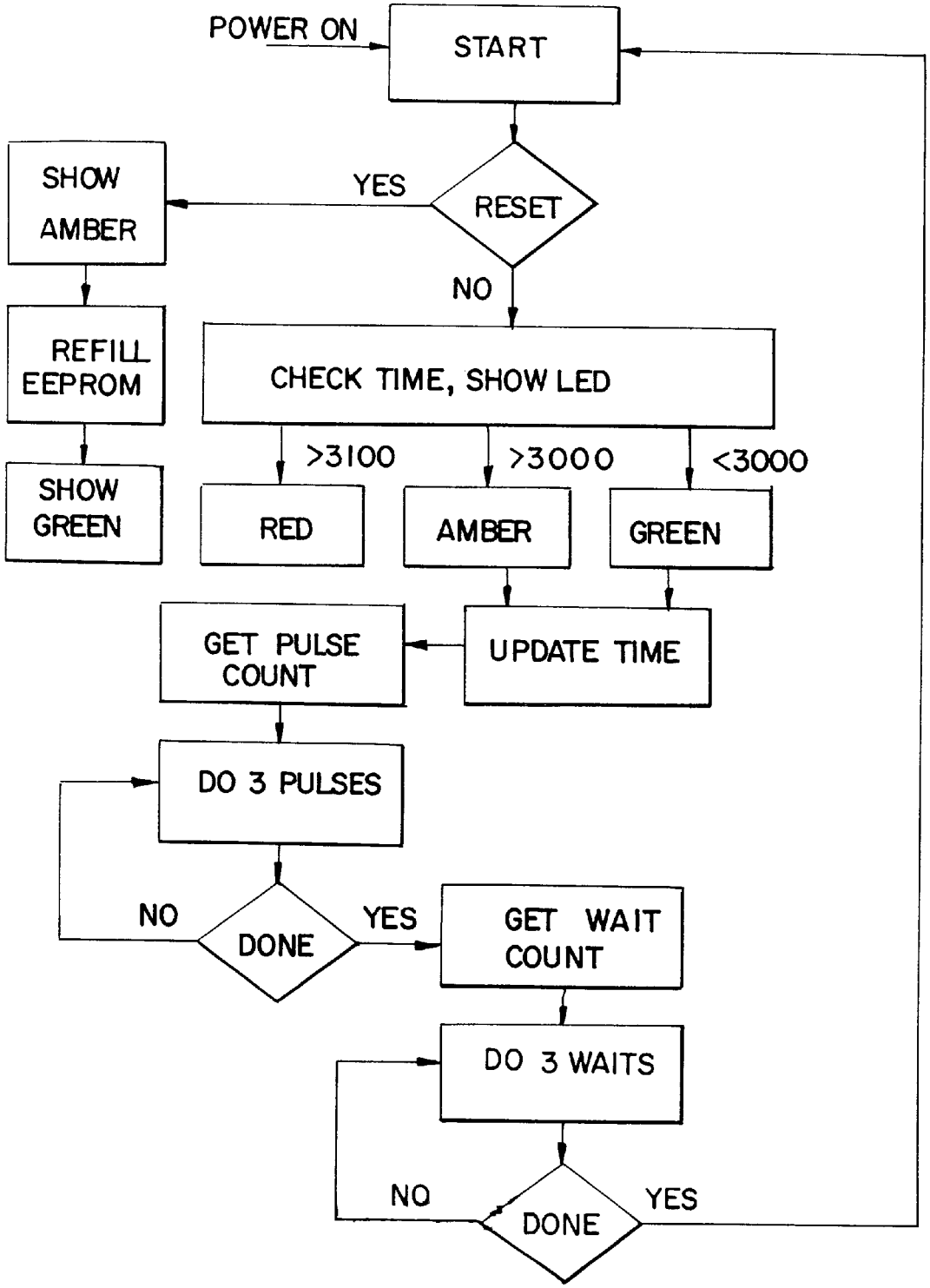
FIG. 6 is a flow diagram illustrating a typical control program for a microprocessor controlled negative air ion generator according to the present invention.

As can be seen in FIG. 6, when power is applied, the microprocessor first checks whether mains power is present via D2 and input RB3. If so, it reads the current EEPROM setting to decide on needle life status. If life exceeds 2100 house, it shows a red light and stops. If life is nearly expired, it shows the amber light, otherwise it shows green and proceeds to update the life value. This is done with reference to the modulation rate setting, this is done once per modulation cycle. The modulation rate setting also is used to define how many of the 17 kHz pulses should be emitted during the active half cycle. Because this value can be more than an 8 bit binary value (256) the program generates three pulses per count. Each pulse mark and space is controlled by a secondary count value and a tight loop.

The same setting value is then re-entered to define the length of the passive half cycle. In fact, the same code is used, but the output is rendered inactive. At this end of this, the program returns to its start and repeats is sequence.

A consideration in the program design is that the EEPROM in the microprocessor is limited to 100,000 writes cycles per cell. However, the life must be updated sufficiently regularly that normal usage will be correctly recorded, no longer than once every fifteen minutes. Thus a single counter would use its life in less than three years. To overcome this, the program instead uses sequential EEPROM cells, as pointed to by the first cell, to count down from 255 to 0. This scheme also results in the simple determination of the 2000 hour point, which occurs when enough EEPROM cells have been "emptied" as recorded by the value in the first cell. Since each cell now carries only 1/50th of the duty, the life is extended for 150 years.

Thus, if the EEPROM is entered in reset mode (battery power only), the micro controller refills all EEPROM cells with a value 255 and sets the point back to the first cell. The process is confirmed to the user by momentary activation of the amber light while the refill process is current, and then by showing the green light.

It will be appreciated the present invention provides in combination a more reliable negative ion generator than previously known in the prior art. In particular, the combination of features involving the replaceable needles in order to inhibit corrosion and the ability to select and vary the proportion and way in which ions are generated provides a significant advance over the prior art.

It will therefore be appreciated that while the above has been given by way of illustrative example of the present invention, many variations and modifications thereto will be apparent to those skilled in the art without departing from the broad ambit and scope of the invention as herein set forth in the appended claims.

I claim:

1. A negative air ion generator comprising at least one emitter, a driver circuit for generating ions at the emitter, the driver circuit producing an ion generation signal, the ion generation signal comprising a carrier wave which is frequency modulated at a selected one of a number of selectable frequencies, the emitter including a needle member and said driver circuit providing voltage to generate ions at an end of the needle member, said ion generator further including a timing circuit and a needle replacement indicator, the timing circuit being operable to actuate the needle replacement indicator after a predetermined period of time indicative of expiration of life of said needle member.

2. The negative air ion generator according to claim 1, wherein the generator further comprises a casing housing the driver circuit, the driver circuit including a control circuit and a high voltage circuit, the control circuit and high voltage circuit being spaced from one another within the casing by a predetermined distance said ion generator further including an insulator disposed between said control circuit and said high voltage circuit in order to prevent arcing between said circuits.

3. The negative air ion generator according to claim 2, wherein ground is disposed adjacent the needle member at a distance of between 15 mm to 20 mm therefrom, and wherein said generator is provided with a plurality of needle assemblies, each of the needle assemblies having a needle member with an associated needle point, said needle assemblies being circumferentially spaced in the form of a ring and said ground comprises a ring disposed at a distance of 15 mm to 20 mm from said ring of needle points.

4. The negative air ion generator according to claim 1, further including at least one needle assembly containing said needle member and, wherein and said needle member of said needle assembly includes a needle point, and said driver circuit providing voltage to said needle point to produce air ions, said needle assembly having a socket surrounded by a socket housing carrying a terminal extending from said housing, the terminal being soldered in contact with said driver circuit, said needle point being removably held in said socket, said socket, said socket housing and said terminal being plated over their entire surfaces with a corrosion resistant material and said needle point is made from a corrosion resistant alloy.

5. The negative air ion generator according to claim 4, wherein said first connector socket contact surfaces and said second connector socket and plug portion contact surfaces thereon are gold plated.

6. The negative air ion generator according to claim 1, wherein said predetermined period of time is determined by an average time period beyond which ion production from said emitter slows to a predetermined level, the timing circuit including a solid state memory device including an electronically erasable programmable read only memory (EEPROM) which is periodically addressed to time said predetermined period of time and to provide a trigger signal in response to the expiration of said predetermined period of time, the memory device being configured to use sequential memory cells as pointed to by the first cell in order to distribute write cycles to the cells, further including a reset switch for resetting said memory device to recommence countdown of said predetermined period of time, the needle replacement indicator providing at least one of: a first indication indicating that said needle member life is currently within said predetermined period of time, a second indication indicating that said needle member life is approaching the end of said predetermined period of time and a third indication indicating that said needle member life has exceeded said predetermined period of time.

7. The negative air ion generator according to claim 6, wherein said predetermined period of time is not less than about 2000 hours and not more than about 2500 hours.

8. The negative air ion generator according to claim 1, wherein said generator includes selection circuit means for selecting ion levels to vary the amount and/or frequency at which ions are produced by said generator, the selection circuit means enabling selection of the quantity of ions produced by changing the magnitude of said ion generation signal to produce more or less ion at any selected frequency setting, said ion generation signal from said driver circuit having a carrier frequency modulated at defined frequencies from 15 Khz to 20 Khz, including a square wave at 17 Khz, and wherein the modulation frequency is selected from one of the following frequencies:

(i) about 40 Hz, (ii) about 25 Hz, (iii) about 10 Hz, or (iv) about 7.83 Hz, and wherein the amount of ions produced varies from about 50,000 negative ions per cubic centimeter at one meter from said generator to about 400,000 negative ions per cubic centimeter at one meter from said generator.

9. The negative air ion generator according to claim 1, further comprising an AC mains power supply inlet to said driver circuit, and having a mains active, mains neutral and mains ground terminal, said driver circuit having an effective ground potential connection between said driver circuit and said mains ground terminal, said generator being provided with a safety current route by way of a resistor to said neutral terminal in the event that said mains ground terminal is faulty.

10. The negative air ion generator according to claim 1, wherein said emitter is a needle point, said driver circuit having a crystal controlled oscillator controlling applications of a time varying voltage to the needle point.

11. The negative air ion generator according to claim 1, wherein said needle member is part of a needle assembly, and said needle member includes a needle point, said driver circuit generating ions at the needle point of the needle assembly by applying said ion generation signal to said needle member, said needle assembly including a first connector for providing a connection to said driver circuit and a second connector for holding said needle member and for engaging said first connector in a frictional and releasable manner, said first connector including a socket for receiving a portion of the second connector therein, said second connector including a plug portion and a needle socket portion, the second connector plug portion releasable engaging said first connector socket and said second connector needle socket portion releaseably engaging said needle member, said first connector socket and said second connector socket and plug portion having contact surfaces thereon that are plated with a corrosion resistant material.

12. The negative air ion generator according to claim 1, wherein said needle member is formed from a corrosion resistant alloy.

13. The negative air ion generator according to claim 12, wherein said needle member is formed from a ruthenium alloy.

14. A negative ion generator for generating selected densities of negative ions, comprising: at least one negative ion emitting member for emitting negative ions into air when a ion generation signal is applied to the ion emitting member, control means for generating a control signal in a pulsed fashion at a predetermined base frequency, means for modulating the predetermined base frequency of said control signal to form an ion generation signal at a predetermined modulated frequency, driver means for applying the ion generation signal to said ion emitting member at said predetermined modulated frequency, said predetermined modulated frequency corresponding to a preselected density of negative ions, and means for selecting said predetermined modulated frequency and thereby selectively vary the density of negative ions emitted at said ion emitting member.

15. The negative ion generator as claimed in claim 14, wherein said predetermined modulated frequency is selected from a plurality of predetermined frequencies.

16. The negative ion generator as claimed in claim 15, wherein said predetermined modulated frequency is selected from a range of predetermined frequencies from about 7.83 Hz to about 40 Hz.

17. The negative ion generator as claimed in claim 15, wherein said predetermined modulated frequency is selected from the following set of predetermined frequencies: (a) about 7.83 Hz, (b) about 10 Hz, (c) about 25 Hz, and about (d) 40 Hz.

18. The negative ion generator as claimed in claim 14, wherein the density of negative ions emitted by said ion emitting member will range from about 50,000 negative ions per cubic centimeter at one meter from said generator to about 400,000 negative ions per cubic centimeter at one meter from said generator, depending on said predetermined frequency of said control signal.

19. The negative ion generator as claimed in claim 14, further including an exterior casing and a plurality of ion emitting members arranged in a radial fashion in said casing.

20. The negative ion generator as claimed in claim 14, wherein said control means generates said control signal at a first predetermined voltage and said driver means includes means for multiplying said first predetermined voltage to a second predetermined voltage greater than said first predetermined voltage, said second predetermined voltage, when applied to said ion emitting member thereby producing a preselected density of negative ions.

21. The negative ion generator as claimed in claim 14, wherein a voltage is applied to said ion emitting member in response to said ion generation signal and said voltage is applied at said modulated frequency of said ion generator signal.

22. The negative ion generator as claimed in claim 14, wherein said means for modulating said control signal base frequency includes an array of resistors and a plurality of switches for routing said control signal through a selected combination of resistors of said resistor array, or through none of said resistors of said resistor array.

23. A negative ion generator for generating selected densities of negative ions at selected frequencies, the frequencies of negative ion generation being selectable, comprising;

at least one negative ion emitting member for emitting negative ions into air when a voltage is applied to the ion emitting member in response to an ion generation signal, means for generating a control signal in a pulsed fashion at a predetermined base frequency, means for modulating the predetermined base frequency of said control signal to obtain a modulated ion generation signal, driver means for applying said voltage to said ion emitting member in response to said modulated ion generation signal, and means for selecting said modulated ion generation signal from a plurality of modulated ion generation signals, said selecting means including a plurality of switches that are manipulable such that actuation of different combinations of switches produce different modulated ion generation signals.

* * * * *